US006494592B1

(12) United States Patent
Rahman

(10) Patent No.: US 6,494,592 B1
(45) Date of Patent: Dec. 17, 2002

(54) NET LIGHT SET WITH SINGLE ACTIVE WIRE

(75) Inventor: Najeh Rahman, Monsey, NY (US)

(73) Assignee: Sienna LLC, Oakland, NJ (US)

( * ) Notice: Subject to any disclaimer, the term of this patent is extended or adjusted under 35 U.S.C. 154(b) by 43 days.

(21) Appl. No.: 09/644,997

(22) Filed: Aug. 24, 2000

(51) Int. Cl.[7] ..... F21V 21/00

(52) U.S. Cl. ..... 362/249; 362/238; 362/252; 362/258; 362/391

(58) Field of Search ..... 362/249, 238, 362/252, 258, 276, 391, 123

(56) References Cited

U.S. PATENT DOCUMENTS 5,424,925 A * 6/1995 Jenke et al. ..... 362/123
5,775,802 A * 7/1998 Kuo ..... 363/396
5,944,408 A 8/1999 Tong et al. ..... 362/252
6,126,298 A 10/2000 Wu ..... 362/252
6,149,284 A 11/2000 Wang ..... 362/249
6,152,576 A 11/2000 Mount ..... 362/252
6,217,193 B1 4/2001 Won
6,302,562 B1 * 10/2001 Wu ..... 362/249

* cited by examiner

*Primary Examiner*—Stephen Husar
*Assistant Examiner*—Bertrand Zeade
(74) *Attorney, Agent, or Firm*—Amster, Rothstein & Ebenstein

(57) ABSTRACT

A net light set includes a first common wire means extending in a first (horizontal) direction, the first common wire means including lengths of a bypass wire and a return wire. A plurality of series-connected light strings extend physically parallel to each other and in a second (vertical) direction transverse to the first direction. Each light string includes a plurality of lamp sockets and a plurality of intermediate lengths of a single active wire connecting the lamp sockets in series. In each of the light strings intermediate the first and last light strings, the single active wire is twisted together intermediate the lamp sockets only with a first non-wire extending in the second direction for enhanced tensile strength. At least one second non-wire extends in the first direction and physically connects intermediate lengths of each light string with corresponding intermediate lengths of other light strings.

42 Claims, 5 Drawing Sheets

NET LIGHT SET WITH SINGLE ACTIVE WIRE

BACKGROUND OF THE INVENTION

The present invention relates to a net light set, and more particularly to an economical net light set using only a single active wire.

Net light sets are well-known in the prior art which exemplifies a broad range of different embodiments. Nonetheless, in the United States the manufacture and sale of a net light set is sharply limited by the standards and requirements of the UL (Underwriters Laboratories). Whether or not the UL requirements have the force of law, a failure to obtain the coveted UL certification may sound the death knell of any commercial electrical product. UL requirements involve standards for ultraviolet (UV)-rating (for outdoor use), temperature resistance, flammability (flame resistance), pull weight (tensile strength) and the like. For example, the UL requires that a current-carrying wire be either by itself of a thickness (18 gauge) such that its use would be uneconomical or thinner (22 gauge) and twisted together with another wire such that the twisted wires in tandem support one another. Thus a prior art net light set typically includes a current-carrying active wire and a current-carrying return wire twisted together to form the various columns or icicles of the light set and optionally a bypass wire extending horizontally from one end of the light set to the other end of the light set and being twisted together at various points along its length with adjacent portions of the twisted together active and return wires. While this latter technique for meeting the UL standard is economically superior to the use of the oversized wire, it is not entirely satisfactory from the point of view of the manufacturer as it requires the use of a return wire which is substantially of the same length as the active wire. The conductive core of the insulated wires is a major expense in the production of light sets, while the insulative outer covering is by itself only a small fraction of the production cost.

Accordingly, it is an object of the present invention to provide a UL-acceptable net light set which is economical to manufacture.

Another object is to provide such a set which employs a return wire of substantially lesser length than the active wire.

A further object is to provide such a light set which is simple and inexpensive to manufacture, use and maintain.

SUMMARY OF THE INVENTION

The above and related objects of the present invention are obtained in a net light set according to the present invention. The net light set comprises a first common wire means extending in a first direction, the first common wire means including lengths of a bypass wire and a return wire. A plurality of series-connected light strings extend physically parallel to each other and in a second direction transverse to the first direction. Each light string includes a plurality of lamp sockets and a plurality of intermediate lengths of a single active wire connecting the lamp sockets in series. In each of the light strings intermediate the first and last light strings, the single active wire is twisted together intermediate the lamp sockets only with a first non-wire extending in the second direction for enhanced tensile strength. At least one second non-wire extends in the first direction and physically connects intermediate lengths of each light string with corresponding intermediate lengths of other light strings. Plug means are disposed at one end of the light set and include the bypass and return wires.

In a Straight Return embodiment, in the first and last light strings, the single active wire is twisted together only with the first non-wire intermediate the lamp sockets for enhanced tensile strength.

In a U-Return embodiment, the first and last light strings are formed of lengths of the single active wire twisted together with lengths of the return wire for enhanced tensile strength, and a second common wire means extends in the first direction parallel to and spaced from the first common wire means, the second common wire means including lengths of the single active wire and/or lengths of the first non-wire twisted together with a single length of the return wire for enhanced tensile strength. The second common wire means further includes lengths of the first non-wire twisted together with the single active wire and the return wires for enhanced tensile strength.

In an Extra Non-wire embodiment, at least one of the first and second common wire means (and preferably each) includes a length of an additional non-wire extending in the first direction between the first light string and the last light string and twisted together with the wires and non-wires thereof.

In a Sub-Set embodiment, the set is in turn comprised of a plurality of series-connected light sub-sets wired in parallel, each light sub-set (except optionally only the last sub-set) further including a bypass wire twisted together with at least one of the first and second common wire means.

In a Multiple Sets embodiment, a plurality of the light sets are provided, and in each light set (excepting optionally only the last light set) an end connector means is disposed at an opposed end of the light set and the bypass wire establishes electrical communication between the plug means and the end connector of the light set.

Preferably, in all embodiments the first and second non-wires resemble the active wire in outward appearance.

The present invention further encompasses a net light set useable as one of a plurality of interconnected net light sets. Each set comprises, at one end of the set, a plug having a pair of conductors for connection to a power supply or an end connector of another light set, and, at an opposite end of the set, an end element selected from the group consisting of an end connector adapted to receive the plug of another light set and means electrically connecting adjacent free ends of the bypass and return wires. A bypass wire extends across the set in electrical communication with a live one of the conductors, and a return wire extends across the set in electrical communication with a return one of the conductors. A plurality of active wires are provided, each active wire extending across a respective one of the subsets substantially in a plurality of electrically and physically interconnected, horizontally spaced vertical strings and being in electrical and physical communication with the bypass wire at a beginning end of a respective subset and with the return wire at a terminal end of a respective subset. A plurality of lamp sockets are disposed in series in electrical and physical communication and spaced along the active wire of each subset. A first non-electrical pseudowire (e.g., a first non-wire) resembling the active wire in outward appearance is twisted together with the active wire in each subset intermediate the lamp sockets thereof in order to provide additional tensile strength to each vertical string of the subset, and at least one second non-electrical pseudowire (e.g., a second non-wire) resembling the active wire in outward appearance connects horizontally aligned segments of the vertical strings of the set to form a net appearance.

There are either a plurality of vertically spaced apart and linearly extending second pseudowires or a single second pseudowire extending throughout the set in a "Z" shape pattern. Each of the at least one second pseudowires directly connects horizontally aligned lamp sockets of the vertical strings of the set to form a net appearance or connects horizontally aligned portions of the active wire and the first pseudowire adjacent the lamp sockets.

Each of the bypass wire, the return wire, and the active wire is formed of an electrically conductive metal core and an electrically insulative sheath thereover, and each of the first and second pseudowires is formed of an electrically insulative polymeric sheath without an electrically conductive metal core therein. The first pseudowire exhibits a tensile strength of at least 28 pounds, while the second pseudowire may exhibit a tensile strength of less than 28 pounds.

The return wire and the bypass wire extend essentially directly across the set at a top thereof, or the bypass wire extends essentially directly across the set at a top thereof and the return wire extends in a U-shape configuration along one vertically extending side, a bottom, and another vertically extending side of the set.

In the former Straight Return embodiment, the return wire and the bypass wire extend essentially directly across the set at a top thereof. Within each subset, adjacent pairs of the vertical strings are connected by the first pseudowire and the active wire twisted together. Alternatively, adjacent pairs of the vertical strings are connected together alternately at the top of one adjacent pair of the vertical strings and at the bottom of the next adjacent pair of the vertical strings.

In the latter U-Return embodiment, the first pseudowire is twisted together with the active wire in each vertical string in each subset (excepting optionally a first vertical string of the first subset and a last vertical string of the last subset), the active wire of the first and last vertical strings being twisted together with portions of the return wire extending along the vertically extending sides of the set. Alternately, portions of the active wire extending across at least one pair of adjacent vertical strings at the bottom of a respective one of the subsets and portions of the first pseudowire extending across at least one other pair of adjacent vertical strings at the bottom of a respective one of the subsets are twisted together with respective successive portions of the return wire. The first pseudowire is twisted together with the active wire in each vertical string in each subset. Portions of the active wire extending across at least one pair of adjacent vertical strings at the top of a respective one of the subsets and portions of the first pseudowire extending across at least one pair of adjacent vertical strings at the top of a respective one of the subsets are twisted together with respective portions of the return and bypass wires. In this instance, portions of the active wire extend across at least one pair of adjacent vertical strings at the top of a respective one of the subsets and portions of the first pseudowire extend across at least one adjacent pair of adjacent vertical strings at the top of a respective one of the subsets. These portions are twisted together with respective portions of the return and bypass wires.

In such a U-Return embodiment, the bypass wire extends essentially directly across the set at a top thereof, but the return wire extends in a U-shape configuration along one vertically extending side, a bottom, and another vertically extending side of the set. The first pseudowire is twisted together with the active wire in each vertical string in each subset (except optionally a first vertical string of the first subset and a last vertical string of the last subset). The active wire of the first and last vertical strings is twisted together with portions of the return wire extending along the vertically extending sides of the set, and, alternately, portions of the active wire extending across at least one pair of adjacent vertical strings at the bottom of a respective one of the subsets and portions of the first pseudowire extending across at least one other pair of adjacent vertical strings at the bottom of a respective one of the subsets are twisted together with respective successive portions of the return wire.

The present invention further encompasses a net light set comprising a common wire means extending in a substantially horizontal first direction, the common wire means including lengths of a single bypass wire and a single return wire. A plurality of series-connected light strings extend physically parallel to each other and in a substantially vertical second direction transverse to the first direction, each light string including a plurality of lamp sockets and a plurality of intermediate lengths of a single active wire connecting the lamp sockets in series. In each of the light strings intermediate the first and last light strings, the single active wire is twisted together intermediate the lamp sockets only with a first non-wire extending in the second direction for enhanced tensile strength. At least one second non-wire extends in the first direction and physically connects intermediate lengths of each light string with corresponding intermediate lengths of other light strings. Plug means are disposed at one end of the light set and including the active and return wires. Adjacent each of the lamp sockets in each of the light strings, intermediate the first and last light strings and intermediate the top and bottom lamp sockets, the second non-wire extends in the first direction and crimps one of the socket-entering and socket-leaving single active wire portions about the other single active wire portion.

Preferably, the second non-wire extends to one side (e.g., the rear) of the socket-entering single active wire and the first non-wire twisted therewith, then to an opposite side (e.g., the front) of the socket-entering single active wire and the socket-leaving single active wire, and finally loops about the socket-entering single active wire before continuing intermediate the socket-entering single active wire and the socket-leaving single active wire in the first direction. Thus, the second non-wire blocks sliding movement of the lamp socket in both the first and second directions, thereby to provide the set with a net appearance.

In a preferred embodiment, spaced apart lengths of the first non-wire on opposite sides of a respective one of the lamp sockets are bridged by a third length of the first non-wire bypassing the respective one lamp socket. The set may additionally including means for commonly orienting the lamp sockets relative to one of the socket-entering and socket-leaving single active wires, the orienting means not functioning to block sliding movement of the lamp socket. Preferably, the first non-wire has a tensile strength of at least 28 lbs., although the second non-wire need not.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

The present invention is predicated on the rationale by which the UL requires that a current-carrying wire be twisted together with another wire providing a minimum 28 pound tensile strength (according to the UL pull strength test) in order to resist breakage of the current-carrying wire, and on the language of the UL standard which does not require that the two wires twisted together both be current-carrying. The present invention recognizes that, for the most part, the use of a return wire which is much shorter than the active wire (either because it extends linearly across the set or in a U-configuration across the set) more than pays for the introduction of a non-wire or pseudowire formed without a conductive core to parallel the active wire and be twisted together therewith to provide the necessary tensile strength. The non-wire or pseudowire may closely resemble the active and/or return wire in outward appearance, but is much cheaper as it does not have an electrically conductive core (e.g., of copper). Instead, the non-wire or pseudowire is preferably made from the same insulative material as the active wire which necessarily satisfies the UL requirements for ultraviolet resistance. For enhanced strength, it preferably has a core made of such non-conductive material as cotton fibers, polyester filaments and the like. Such core material combines with the insulative material to provide the necessary tensile strength to satisfy UL pull weight tests.

Figure 1:
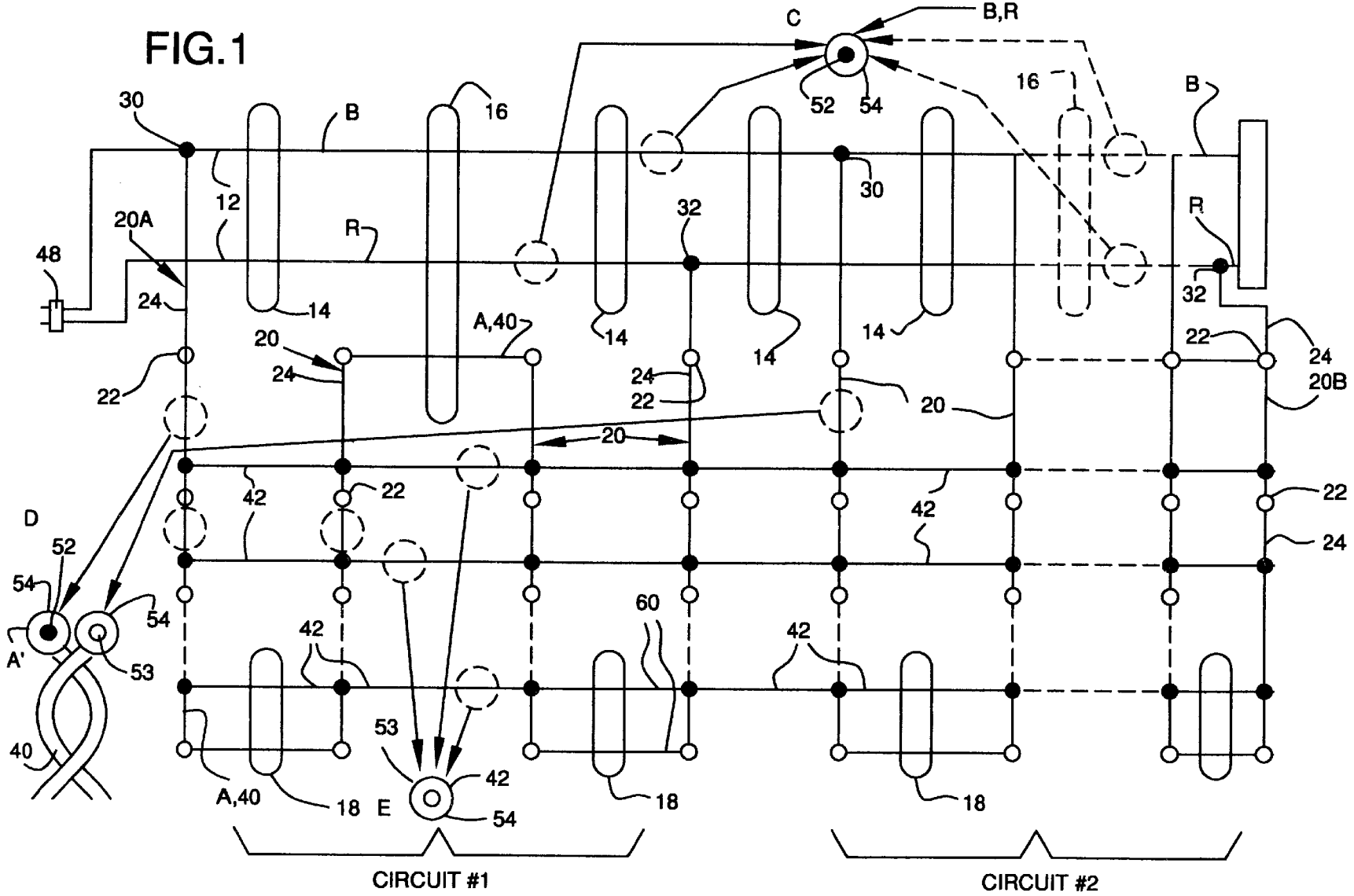
FIG. 1 is a schematic view of a partial net light set according to the present invention.

Referring now to the drawing, and in particular to FIG. 1 thereof, therein illustrated is a simplified schematic of a net light set according to the present invention, generally designated by the reference numeral 10. A first common wire means 12 extends in a first direction, as illustrated a substantially horizontal direction. The common wire means 12 includes lengths of a single bypass wire B and a single return wire R. The short vertically extending ellipses 14 in the schematic indicate that only the two B, R wires are twisted together in the common wire means 12. Each of the bypass wire B and the return wire R are conventional insulated wires containing an electrically conductive core such as copper.

A plurality of series-connected light strings, generally designated 20, extend physically parallel to each other and in a second direction, as illustrated a substantially vertical direction, transverse to the preferably horizontal first direction. Each light string 20 includes a plurality of lamp sockets 22 and a plurality of intermediate lengths 24 of a single active wire A connecting the lamp sockets 22 in series.

As illustrated, FIG. 1 shows two light sub-sets or circuits, with the first light string 20 of each sub-set being in electrical communication at one end with the bypass wire B at 30 and at the opposite end with the return wire R at 32. In each of the light strings 20 intermediate the first and last light strings 20A and 20B (and, as illustrated, in the first and last light strings 20A, 20B as well), the single active wire A is twisted together intermediate the lamp sockets 22 only with a first non-wire 40 extending in the preferably vertical second direction for enhanced tensile strength. More particularly, the tensile strength of the non-wire must be at least 28 pound s to meet present UL standards.

The active wire A for a sub-set or circuit follows a meandering pathway, beginning at a point 30 of electrical communication with the single bypass wire B of the common wire means 12 and ending with a point 32 of the electrical communication with the return wire R of the common wire means 12. Where the bypass and return wires B, R alone extend in the preferably horizontal first direction as part of the common wire means 12, they are illustrated as joined together by a short vertically extending ellipse 14 signifying that the two current-carrying bypass and return wires B, R are twisted together, thereby to increase the overall tensile strength of the common wire means 12 and for aesthetic reasons. Where a length of the active wire A is also extending in the preferably horizontal first direction along with the bypass and return wires B, R, they are illustrated as joined together by a long vertically extending ellipse 16 (of greater length than ellipse 14) signifying the twisting together of the three wires A, R, B.

Figure 2:
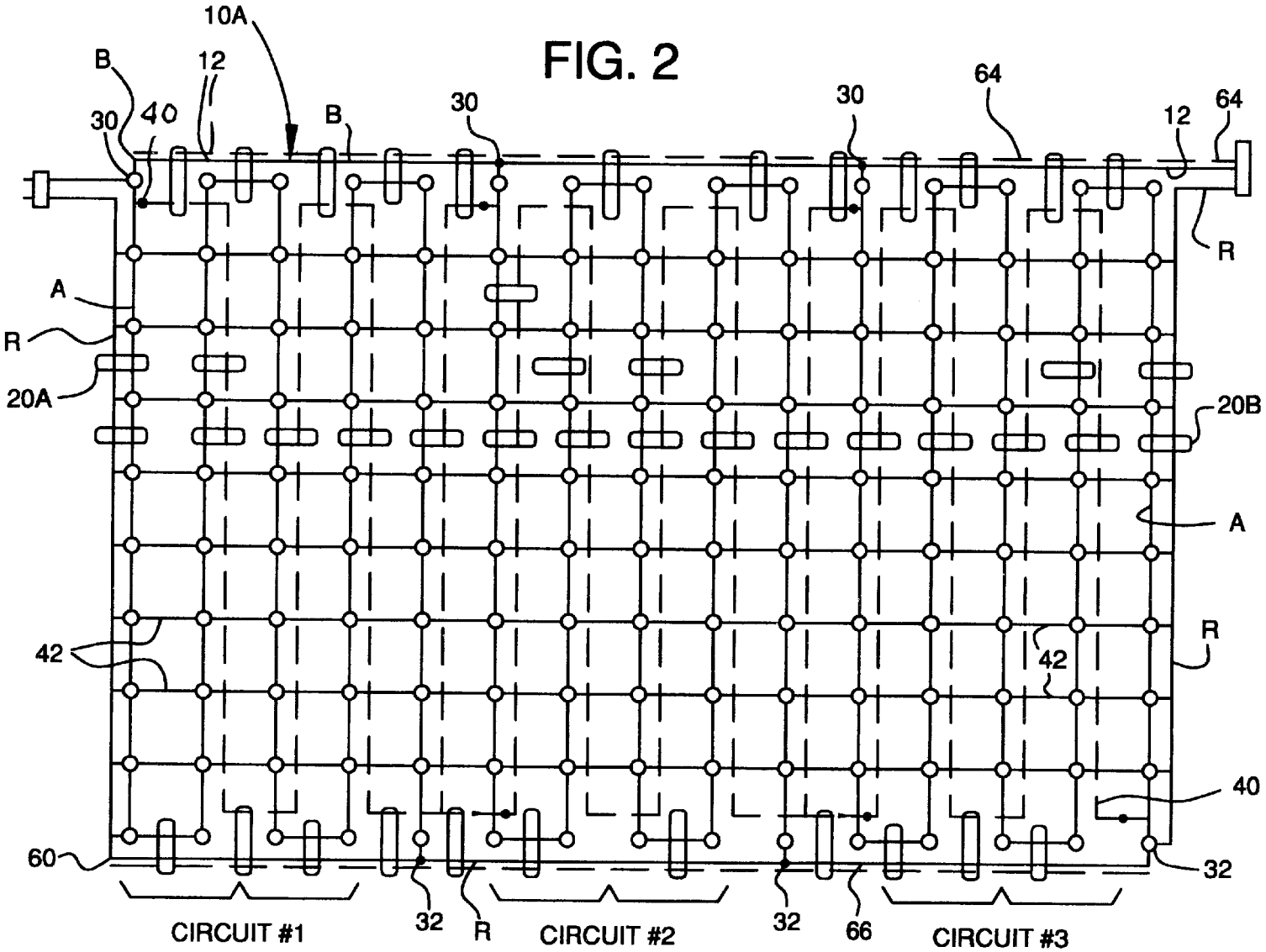
FIGS. 2 and 2A are schematic views of two different 150-lamp net light set embodiments with a U-shaped return wire.

At least one second non-wire 42 extends in the preferably horizontal first direction and physically connects intermediate lengths 24 of each light string 20, 20A, 20B with corresponding intermediate lengths 24 of other light strings. More particularly, the second non-wire 42 may extend from the intermediate length 24 of the first light string 20A, through the intermediate lengths 24 of intermediate light string 20, to the intermediate length 24 of the last light string 20B. The second non-wire 42 is connected at each end either to the intermediate length 24 adjacent the appropriate socket 22 or to the appropriate socket 22 itself. Typically a plurality of vertically spaced, horizontally extending second non-wires 42 are employed as illustrated in FIGS. 1 and 2. Alternatively, as will be described in connection with FIG. 2A, a single second non-wire 42 may extend in a Z-shape so that the adjacent vertically spaced, horizontal lengths of the second non-wire 42 are vertically connected adjacent either the first light string 20A or the last light string 20B by a vertical section of the second non-wire 42. As aforenoted, the upper horizontally extending lengths of the active wire A may be incorporated into the first or upper common wire means 12 by twisting therewith (as illustrated by the long vertically extending ellipses 16), and the lower horizontally extending lengths of the active wire A may be incorporated into a second or lower common wire means 60, by twisting therewith (as illustrated by the short vertically extending ellipsis 14), again both for extra tensile strength and enhanced aesthetics.

A plug means 48 is disposed at one end of the light set 10 (preferably the initial end) and includes both the bypass and return wires B, R. These two wires are connected together at the opposite end of the light set 10.

Referring still to FIG. 1 therein illustrated are three enlargements C, D and E which graphically disclose the nature of the "wires and non-wires" at various points. Thus, enlargement C shows that the bypass wire B and return wire R are conventional in nature with an electrically conductive core 52, typically of a metal such as copper, surrounded by an electrically insulative polymeric sheath 54.

Enlargement D shows the active wire A also being conventional in nature (with a conductive core 52 and a non-conductive polymeric sheath 54) but twisted with a first "non-wire" 40 (also called a "pseudowire"), the non-wire 40 lacking the conductive core of a conventional wire—e.g., the active wire A. The first non-wire 40 is preferably in outward appearance the same as the active wire A. The difference between the conventional wire A, B, R and the non-wire 40 is that the latter lacks an electrically conductive core 52. In other words, it may consist only of the polymeric insulative sheath 54 normally disposed about the conductive core 52 of a conventional wire. On the other hand, the non-wire 40 preferably includes a central non-conductive core 53 of cotton, polyester, nylon or the like which contributes significantly to the tensile strength of the non-wire 40 (which must be at least 28 lbs. to meet UL standards) and thus to that of the combination of the non-wire 40 and the conventional active wire A twisted together.

Enlargement E shows that the second non-wire 42 is similar to the first non-wire 40 in that it too lacks an electrically conductive core 52 and consists solely of the insulative polymeric sheath 54 (although optionally the second non-wire 42 may also have an electrically non-conductive core 53).

It will be appreciated that the first and second non-wires 40 and 42 have been illustrated with electrically non-conductive cores illustrated as hollow circles in order to highlight the contrast between such non-wires 40, 42 and the conventional wires B, A, R with their electrically conductive cores 52 illustrated as solid black circles. As noted above, in fact the non-wires 40, 42 may or may not have an electrically non-conductive core 53 therein to enhance the tensile strength thereof.

The present invention easily satisfies the UL standards at a minimum cost. Aside from the relatively short straight lengths of conventional wires B, R in the common wire means 12, the only other conventional wire required is the single active wire A of each circuit which connects at the initial end 30 with the bypass wire B and at the terminal end 32 with the return wire R. No current carrying wire is disposed by itself—that is, without being twisted around another wire A, B, R or non-wire 40, 42. In the common wire means 12, at least wires B and R are twisted together. In the various light strings 20, the active wire A is at all times twisted together with the first non-wire 40 to form a combination "wire/non-wire" assembly A, 40. The second non-wire 42 carries no electricity (because it has no conductive core) and is optionally twisted with lengths of the combination assembly A, 40 only at the tip and/or bottom of the light set 10. Only the second non-wire 42 is not twisted together with another wire or non-wire throughout its length, but, since it is not current-carrying, it does not have to meet the UL standards for current-carrying wires.

Thus, it will be appreciated that the novel design of the present invention provides extensive economical benefits while still meeting UL standards for twisting by substituting for a conventional conductive wire twisted together with the active wire A a non-electrically conductive non-wire 40.

In the Straight Return embodiment of FIG. 1, in the first and last light strings 20A and 20B, the single active wire A is twisted together only with the lengths 24 of the first non-wire 40 intermediate the lamp sockets 42 for enhanced tensile strength. The connection 30, 32 of the active wire A with the bypass wire B of the common wire means 12 at 30 and with the return wire R of the common wire means 12 at 32, respectively, occurs at the top or upper edge of the light set, generally in the same horizontal plane containing the first common wire means 12.

As a practical matter, the light set cannot always be constructed with a desired number of light strings and a desired number of light sockets on each light string, such that the intersection points 30, 32 between the active wire A and the bypass wire B at 30 and the return wire R at 32 will always be disposed at the upper edge of the light set. In some instances it will be necessary that the intersection points 30 and/or 32 will necessarily be disposed at the opposite or lower edge of the light set. Consider, for example, a 150 lamp light set having three sub-sets of 50 bulbs each, each sub-set being divided into five light strings.

Referring now to FIG. 2 in particular, therein illustrated is a "U-shape return" embodiment of the present invention, generally designated 10A for use, where the connections 32 between the active wire A and the return wire R must be disposed at the lower edge of the light set. More specifically, therein illustrated is a light set 10A composed of three series-connected 50 lamp circuits or sub-sets wired in parallel (circuit number 1, circuit number 2 and circuit number 3), with each circuit being a 50-lamp, 5-light string sub-set of the light set 10A. Each sub-set includes a single active wire A having horizontal extents which are twisted together with lengths of a bypass wire B and/or a return wire R in the first common wire means 12 and the second common wire means 60, respectively. Each sub-set comprises a connection of the active wire A with the bypass wire B at the initial end 30 and a connection of the active wire A with the return wire R at the terminal end 32 of the sub-set. Because the return wire R extends vertically downwardly from the upper edge of the light set to the lower edge of the light set, then horizontally across the lower edge of the light set from the first light string of the sub-set to the last light string of the subset, and finally vertically upwardly from the lower edge of the light set to the upper edge of the light set, the return wire is in a U-shape configuration. In this instance, the bight of the U-shape enables the lower horizontal connecting lengths of the active wire A and the first non-wire 40 to be twisted together with a lower horizontal length of the return wire R, thereby to form a second or lower common wire means 60 extending in the preferably substantially horizontal first direction parallel to and vertically spaced from the first or upper common wire means 12. Thus, second common wire means 60 includes lengths of single active wire A and lengths of the first non-wire 40 twisted together with a length of a single return wire R for enhanced tensile strength.

Since the return wire R is a current-carrying wire, it must be twisted together with the active wire A of the first and last light strings 20A, 20B. While this suffices to provide a "twisting together" in the vertical legs of the U-shaped return wire R, it does not provide for a twisting together of the bight or horizontal extent of the U-shaped return wire R intermediate each and every light string 20. Accordingly, as illustrated in FIG. 2, between adjacent light strings 20 and only between them, the first non-wire 40 and the active wire A may be separate (i.e., not twisted together), with the first non-wire 40 being part of the first and second common wire means 12, 60 at the upper and lower edges of the light set 10A (between the first and last light strings 20A, 20B), and the active wire A being part of the first and second common wire means 12, 60 at the upper and lower edges of the light set 10A (between the first and last light strings 20A, 20B). In this manner, sections of the lower horizontal extent or bight of the return wire R are twisted together alternately with the horizontal extents of the active wire A and the horizontal extents of the first non-wire 40. The result, of course, is that the full lower edge horizontal extent or bight of the return wire R is twisted together with another "wire or non-wire," whether it be the active wire A or the first non-wire 40. Similarly, sections of the upper horizontal extend or bight of the bypass wire B are twisted together alternately with the horizontal extents of the active wire A and the horizontal extents of the first non-wire 40. The result, of course, is that the full horizontal extent of the bypass wire B is twisted together with another "wire or non-wire," whether it be the active wire A or the first non-wire 40.

Still referring to FIG. 2, in order to provide additional tensile strength to the upper and lower horizontal extent of the light set 10A, an optional additional non-wire 64, 66 may be inserted into the first common wire means 12 and the second common wire means 60, respectively. These non-wires 64, 66 provide additional tensile strength to the first and second common wire means 12, 60 and desirably contribute additional bulk as well. Thus, the full length of each of the first common wire means 12 and the second common wire means 60 includes, respectively, a length of an additional non-wire extending in the preferably horizontal first direction (between the first light string 20A and the last light string 20B) and being twisted together with the "wires and non-wires" of the first common wire means 12 and the second common wire means 60, respectively.

The first non-wire 40 of the first circuit begins at the top of the second light string of the first circuit, is twisted together with a vertical extent of the active A and continues without interruption to the top of the last light string of the first circuit. The first non-wire 40 of the second circuit begins at the bottom of the first light string of the second circuit, is twisted together with a vertical extent of the active wire A and continues without interruption to the top of the last light string of the second circuit. Finally, the first non-wire 40 of the third circuit begins at the bottom of the first light string of the third circuit, is twisted together with a vertical extent of the active wire A, and continues without interruption to the bottom of the penultimate light string of the third circuit.

In a variation of the schematic shown in FIG. 2, the bypass wire B, rather than traveling most directly across the light set 10 in the first common wire means 12, may be twisted together with the U-shape return wire R so that it too has a U-shaped configuration. In this instance, the additional non-wire 64 would be twisted together with the horizontal extents of the active wire A and first non-wire 40 at the top of the light set to provide the desired tensile strength.

Figure 2A:
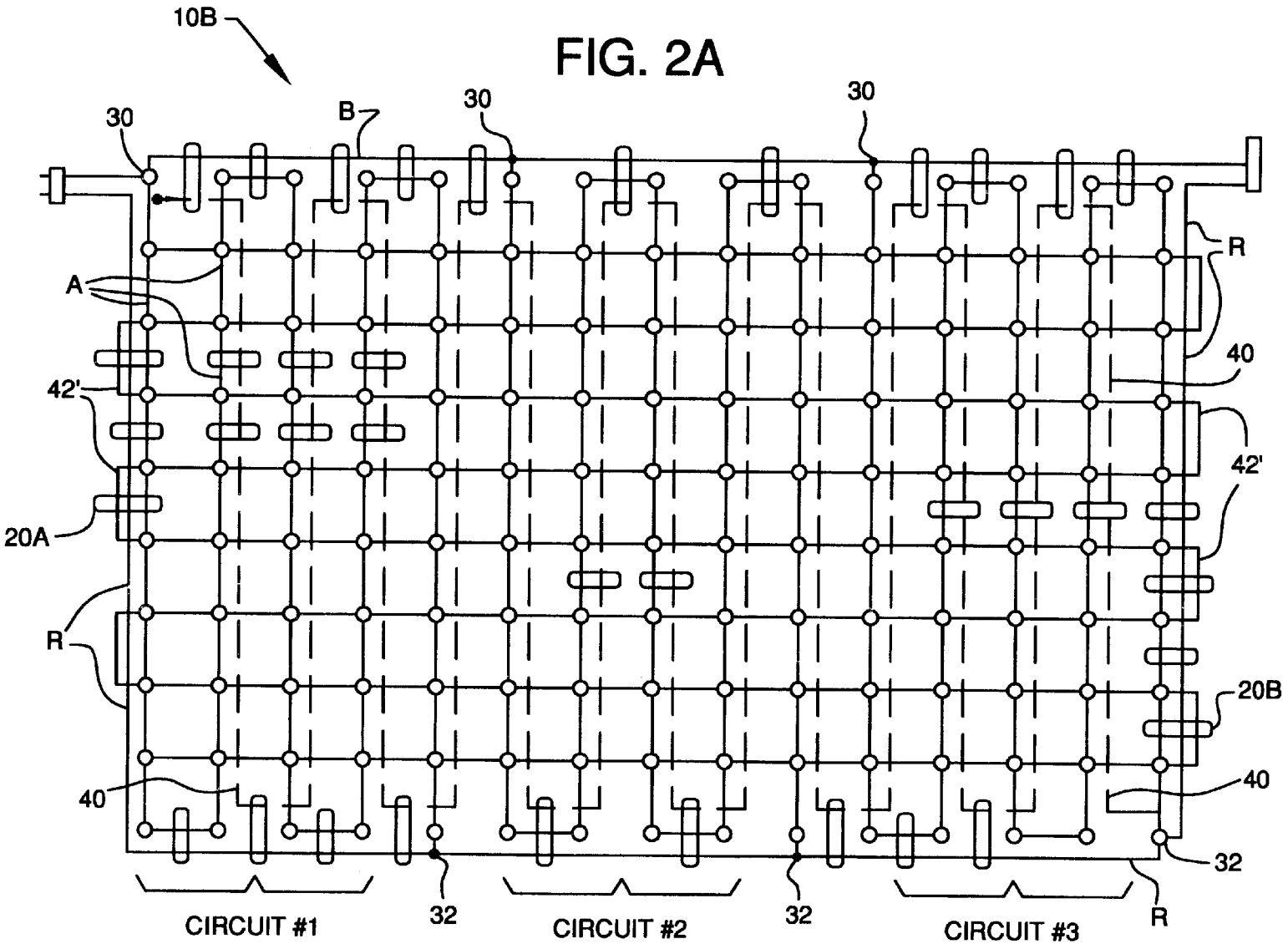

FIG. 2A is generally similar to FIG. 2 except that the optional additional wires 64, 66 are omitted (although either or both may be present if desired). Further, in FIG. 2A the second non-wire is not a plurality of separate and distinct horizontally extending non-wires 42 (as in FIG. 2), but is rather a single Z-shaped non-wire 42'. The second non-wire 42' includes not only the horizontal extents of the second non-wires 42 of FIG. 2, but also vertical extents which connect vertically spaced adjacent horizontal extents alternately at opposite sides of the light set (that is, alternately adjacent the first light string 20A and then the last light string 20B).

A further difference between FIGS. 2 and 2A is that FIG. 2A illustrates a first non-wire 40 which is twisted together with and travels along the same vertical axes of the active wire A from the second light string 20 to the penultimate light string 20 (i.e., travels along the active wire A of all of the light strings except for the first 20A and last 20B), albeit in opposite directions in the first and third circuits (but not along the horizontal extents between the light strings). This reduces the number of wire and non-wire elements which must be manipulated during formation of the light set. Thus, each first non-wire 40 of FIG. 2 continues only through a given circuit (and not through all of the circuits). By way of contrast, the first non-wire 40 of FIG. 2A is continuous from the beginning thereof to the end thereof, without regard to the number of circuits therebetween.

The choice between the first non-wire configurations of FIGS. 2 and 2A may depend upon various factors including the ease of manufacture and assembly, the number of wires and non-wires to be assembled, etc.

Figure 3:
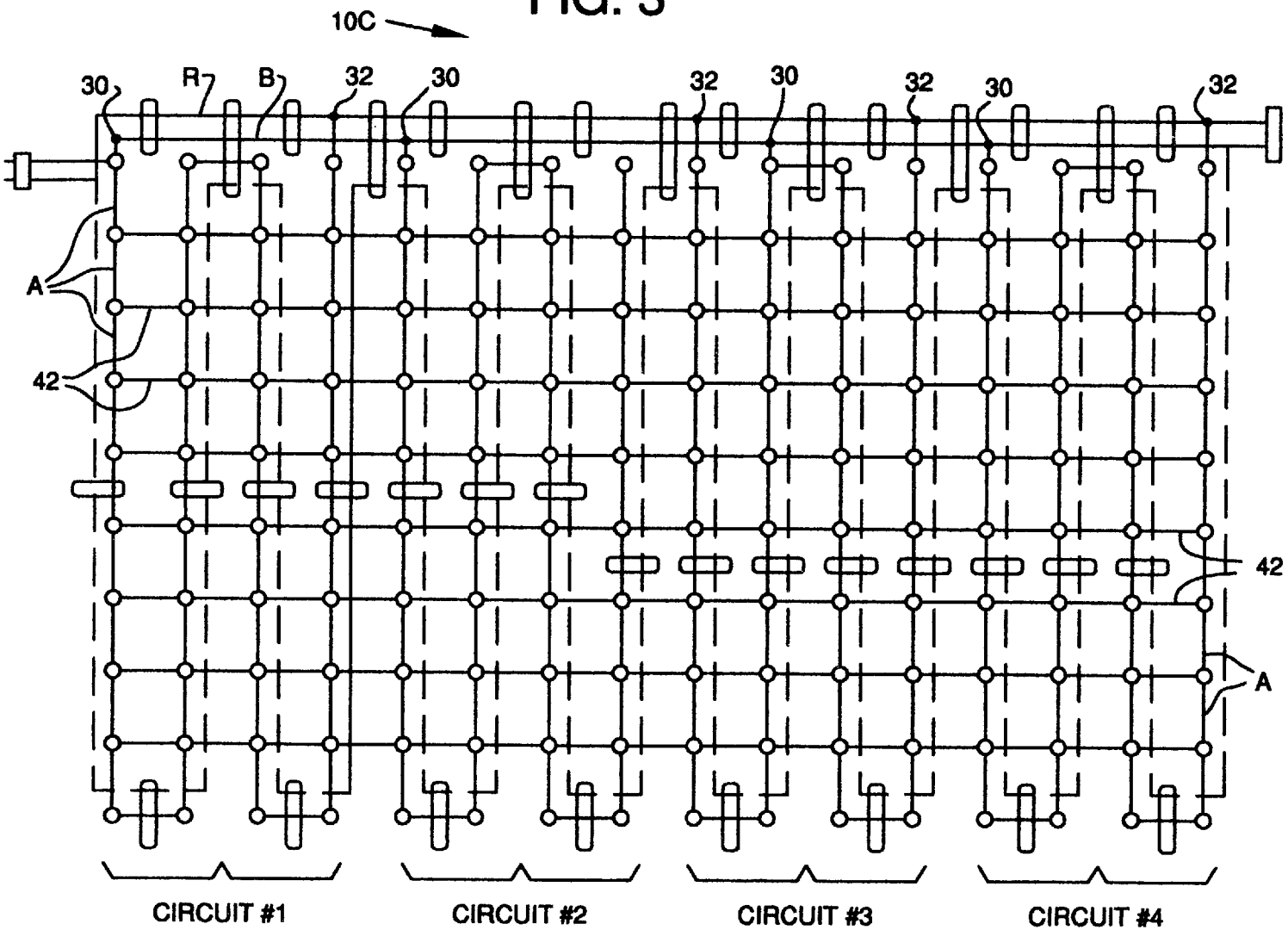
FIG. 3 is a schematic view of a 160-lamp net light set embodiment with a straight return wire.

FIG. 3 is substantially similar to FIG. 1 in that it uses a straight or linear return wire R twisted together with at least the bypass wire B. However, FIG. 3 illustrates a 160 lamp light set composed of four circuits or sub-sets (circuit numbers 1–4), each circuit or subset in turn being composed of forty lamps divided into four light strings of ten bulbs each. The use of an even number of light strings enables both of the connection points 30, 32 to be disposed at the upper edge of the sub-set and thus facilitates communication with the appropriate wires of the first common wire means 12 and further reduces the cost of production.

For purposes of clarity, only representative ellipses 14, 16 are illustrated in FIGS. 2–3.

In those instances where multiple light sets are to be electrically and physically interconnected by a plug and/end connector assembly, the bypass wire B necessarily extends from the plug (or closely adjacent thereto) to the end connector so that the full voltage differential presented to the plug is also presented to the end connector. However, where the light set is devoid of an end connector enabling an additional light set to be interconnected therewith, the bypass wire need only extend from the plug (or closely adjacent thereto) to the connection point 30 with the last circuit or sub-set, since this is the last circuit or sub-set which requires the application of the full voltage differential thereto. Nonetheless, to whatever extent the bypass wire B serves a structural function (that is, is necessary to meet UL standards for tensile strength), it may be preferable to have the bypass wire terminate at the terminal end 32 of the last sub-set (rather than the initial end 30 of the last sub-set). Depending upon the context in which it is used, the bypass wire B may be used to present the full voltage differential to each sub-set of a given multi-sub-set light set and/or to each light set of an interconnected plurality of light sets.

As will be apparent to those skilled in the art, the Z-shaped return wire $4^{21}$ of FIG. 2A may be substituted for the plurality of linear second non-wires 42 in FIGS. 1, 2 and 3, and the plurality of linear second non-wires 42 of FIGS. 1, 2 and 3 may be substituted for the Z-shaped return wire $4^{21}$ of FIG. 2A.

As will be further apparent to those skilled in the art, the single first non-wire 40 per light set construction of FIGS. 2A and 3 may be used in the embodiment of FIGS. 1 and 2, and the single first non-wire 40 per circuit construction of FIGS. 1 and 2 may be used in the embodiments of FIGS. 2A and 3.

In order to maintain the matrix-like net-like appearance of the light set contemplated by the manufacturer, the second non-wires 42, $4^{21}$ (whether linear or Z-shaped) should loop around the points of intersection with the various light strings in such a manner as to preclude substantial movement of the lamp sockets 22 upwardly or downwardly in a vertical direction or to the left or right in a horizontal direction (except for a pivotal movement). This may be accomplished without using knots (except optionally at each end of a second non-wire 42 or at each end of the non-wire $42^1$) through appropriate looping of the second non-wire about the light string 20.

Figure 4:
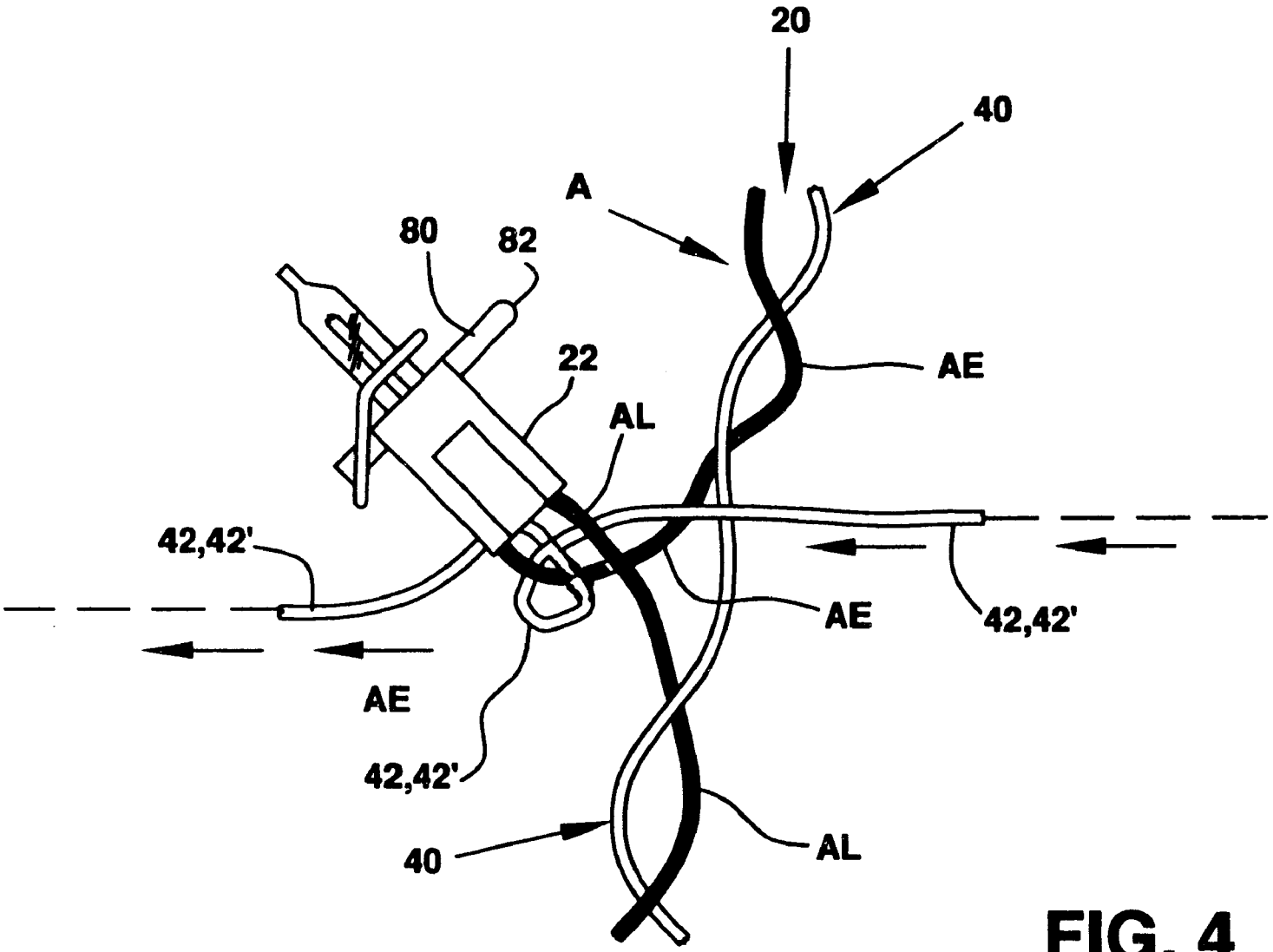
FIG. 4 is a schematic view, to a greatly enlarged scale, of the looping about a lamp socket.

Referring now to FIG. 4 in particular, therein illustrated is a schematic of the looping of the second non-wire 42, $42^1$ about the wires adjacent to a lamp socket 22 so as to preclude substantial vertical or horizontal motion. The active wire A is divided into a socket-entering portion AE and a socket-leaving portion AL. Active wire portions AE and AL are in electrical communication through the lamp of the lamp socket 22. For purposes of orientation, the active wire entering portion AE extends downwardly from the top to the base of the lamp socket and the active wire leaving portion AL extends downwardly from the lamp socket base towards the bottom. The first non-wire 40 is initially twisted together with the active wire entering portion AE, and then become twisted together with the active wire leaving portion AL, as it extends from the top to the bottom. The second non-wire 42, $4^{21}$ extends substantially horizontally from one end (as illustrated, the right end) and leaves towards the other end (as illustrated, the left end). In a preferred embodiment, the second non-wire extends to one side of the first non-wire 40 and the active wire entering portion AE (as illustrated, in front thereof) and then continues to the other side of the active wire leaving portion AL and the active wire entering portion AE (as illustrated, to the rear thereof) closely adjacent the socket base. Further, the second non-wire then loops about the active wire entering portion AE and between the active wire entering and leaving portions AE, AL (between the base of lamp socket 22 and the second non-wire loop) before continuing horizontally away from the socket base. Thus, when the second non-wire 42, 42$^1$ is tensioned horizontally by pulling the ends thereof outwardly away from the socket 22, it causes the active wire entering portion AE to crimp about the active wire leaving portion AL while at the same time crimping the active wire leaving portion AL about the active wire entering portion AE. In other words, the crimp of the active wire entering portion AE about the portion AL and the crimp of the active wire leaving portion AL about the portion AE together substantially immobilizes the socket 22 by immobilizing both of the wires portions AE, AL passing therethrough.

While it is appreciated that the double crimping action effected by the second non-wire 42, 42$^1$ may be effected in a variety of alternative means, the loop configuration illustrated in FIG. 4 is preferred.

While the lamp socket 22 cannot be substantially moved vertically up or down the light string 20 and cannot be substantially moved horizontally right or left along the second non-wire 42, 42$^1$, it can be tilted or re-oriented. Accordingly, the lamp socket 22 preferably includes a resilient lug 80 open lightly at its free end 82. When the lamp socket 22 is rotated to a pre-determined desirable orientation (usually pointing upwardly and parallel to the light string 20), the light string wires A, 40 are forcefully received within the lug 80 so as to orient the lamp socket 22 in a particular direction relative thereto and then maintain that orientation so that all of the lamps of all of the light sockets 22 of the lamp set are similarly oriented. It will be appreciated, however, that the spatial fixing of the loops about the lamp sockets 22 does not depend on use of the lug 80 to orient the lamp socket 22 relative to the wires and non-wires.

To summarize, the present invention provides a UL-acceptable net light set which is economical to manufacture because the return and/or return and bypass wires are of substantially lesser lengths than the active wire. The light set is simple and inexpensive to manufacture, use and maintain.

Now that the preferred embodiments of the present invention have been shown and described in detail, various modifications and improvements hereon will become readily apparent to those skilled in the art. Accordingly, he spirit and scope of the present invention is to be construed broadly and limited only by the appended claims, and not by the foregoing specification.

I claim:

1. A net light set comprising:

(A) a first common wire means extending in a first direction, said common wire means including lengths of a bypass wire and a return wire;

(B) a plurality of series-connected light strings extending physically parallel to each other and exclusively in a second direction transverse to the first direction, each said light string including a plurality of lamp sockets and a plurality of intermediate lengths of a single active wire connecting said lamp sockets in series, in each of said light strings intermediate the first and last light strings said single active wire being spaced from any other light string and twisted together intermediate said lamp sockets only with a first non-wire extending exclusively in the second direction for enhanced tensile strength;

(C) at least one second non-wire extending in the first direction and physically connecting intermediate lengths of each said light string with corresponding intermediate lengths of other light strings; and (D) plug means disposed at one end of said light set and including said active and return wires.

2. The set of claim 1 wherein, in said first and last light strings, said single active wire is twisted together only with said first non-wire intermediate said lamp sockets for enhanced tensile strength.

3. The set of claim 1 additionally comprising:

(E) said first and last light strings being formed of lengths of said single active wire twisted together with lengths of said return wire for enhanced tensile strength; and (F) a second common wire means extending in the first direction parallel to and spaced from said first common wire means, said second common wire means including lengths of said single active wire and/or lengths of said first non-wire twisted together with a single length of said return wire for enhanced tensile strength.

4. The set of claim 3 wherein said second common wire means further includes lengths of said first non-wire twisted together with said single active and return wires for enhanced tensile strength.

5. The set of claim 3 wherein at least one each of said first common wire means and said second common wire means includes a length of an additional non-wire extending in the first direction between said first light string and said last light string and twisted together with the wires and non-wires thereof.

6. The set of claim 3 in turn comprised of a plurality of series—connected light sub-sets wired in parallel, each said light sub-set except for the last sub-set further including a bypass wire twisted together with at least one of said first and second common wire means.

7. A plurality of the light sets of claim 1 wherein, in each light set excepting only the last light set, an end connector means is disposed at an opposed end of said light set and said bypass wire establishes electrical communication between said plug means and said end connector of said light set.

8. The set of claim 1 wherein said first and second non-wires resemble said active wire in outward appearance.

9. A net light set defining a plurality of net light subsets, each set comprising:

(A) at one end of said set, a plug having a pair of conductors for connection to a power supply or an end connector of another light set;

(B) a bypass wire extending across said set in electrical communication with a live one of said conductors;

(C) a return wire extending across said set in electrical communication with a return one of said conductors;

(D) a plurality of active wires, each active wire extending across a respective one of said subsets substantially in a plurality of electrically and physically interconnected, horizontally spaced vertical strings and being in electrical and physical communication with said bypass wire at a beginning end of a respective subset and with said return wire at a terminal end of a respective subset;

(E) a plurality of lamp sockets disposed in series in electrical and physical communication and spaced along said active wire of each subset;

(F) at an opposite end of said set, an end element selected from the group consisting of an end connector adapted to receive the plug of another light set and means electrically connecting adjacent free ends of said active and return wires;

(G) a first non-electrical pseudowire resembling said active wire in outward appearance and being twisted together with said active wire in each subset intermediate said lamp sockets thereof in order to provide additional tensile strength to each said vertical string of said subset; and (H) at least one second non-electrical pseudowire resembling said active wire in outward appearance and connecting horizontally aligned segments of said vertical strings of said set to form a net appearance.

10. The light set of claim 9 wherein there are a plurality of vertically spaced apart second pseudowires.

11. The light set of claim 9 wherein there is a single second pseudowire extending throughout said set in a "Z" shape pattern.

12. The light set of claim 9 wherein each of said at least one second pseudowires directly connects horizontally aligned lamp sockets of said vertical strings of said set to form a net appearance.

13. The light set of claim 9 wherein each of said at least one second pseudowires directly connects horizontally aligned portions of said active wire and said first pseudowire adjacent said lamp sockets.

14. The light set of claim 9 wherein each of said bypass wire, said return wire, and said active wires is formed of an electrically conductive metal core and an electrically insulative sheath thereover, and each of said first and second pseudowires is formed of an electrically insulative sheath without an electrically conductive metal core therein.

15. The light set of claim 9 wherein said first pseudowire has a tensile strength of at least 28 pounds.

16. The light set of claim 9 wherein said second pseudowire has a tensile strength of less than 28 pounds.

17. The light set of claim 9 wherein, within each subset, adjacent pairs of said vertical strings are connected by said first pseudowire and said active wire twisted together.

18. The light set of the claim 17 wherein said adjacent pairs of said vertical strings are connected together alternately at the top of one adjacent pair of said vertical strings and at the bottom of the next adjacent pair of said vertical strings.

19. The light set of claim 9 wherein said return wire and said bypass wire extend essentially directly across said set at a top thereof.

20. The light set of claim 9 wherein said bypass wire extends essentially directly across said set at a top thereof, and said return wire extends in a U-shape configuration along one vertically extending side, a bottom, and another vertically extending side of said set.

21. The light set of claim 20 wherein said first pseudowire is twisted together with said active wire in each vertical string in each subset except a first vertical string of the first subset and a last vertical string of the last subset, said active wire of said first and last vertical strings being twisted together with portions of said return wire extending along said vertically extending sides of said set.

22. The light set of claim 20 wherein, alternately, portions of said active wire extending across at least one pair of adjacent vertical strings at the bottom of a respective one of said subsets and portions of said first pseudowire extending across at least one other pair of adjacent vertical strings at the bottom of a respective one of said subsets are twisted together with respective successive portions of said return wire.

23. The light set of claim 9 wherein said first pseudowire is twisted together with said active wire in each vertical string in each subset.

24. The light set of claim 23 wherein portions of said active wire extending across at least one pair of adjacent vertical strings at the top, of a respective one of said subsets and portions of said first pseudowire extending across said at least one pair of adjacent vertical strings at the top of a respective one of said subsets are twisted together with respective portions of said return and bypass wires.

25. A single wire net light set defining a plurality of single wire net light subsets, each set comprising:

(A) at one end of said set, -a plug having a pair of conductors for connection to a power supply or an end connector of another light set;

(B) a bypass wire extending across said set in electrical communication with a live one of said conductors;

(C) a return wire extending across said set in electrical communication with a return one of said conductors; said return wire and said bypass wire extending essentially directly across said set at a top thereof;

(D) a plurality of active wires, each active wire extending across a respective one of said subsets substantially in a plurality of electrically and physically interconnected, horizontally spaced vertical strings and being in electrical and physical communication with said bypass wire at a beginning end of a respective subset and said return wire at a terminal end of a respective subset;

(E) a plurality of lamp sockets disposed in series in electrical and physical communication and spaced along said active wire of each subset;

(F) at an opposite end of said set, an end element selected from the group consisting of an end connector adapted to receive the plug of another light set and means electrically connecting adjacent free ends of said active and return wires;

(G) a first non-electrical pseudowire resembling said active wire in outward appearance and being twisted together with said active wire in each subset intermediate said lamp sockets thereof in order to provide additional tensile strength to each said vertical string of said subset; and (H) at least one second non-electrical pseudowire resembling said active wire in outward appearance and connecting horizontally aligned segments of said vertical strings of said set to form a net appearance;

portions of said active wire extending across at least one pair of adjacent vertical strings at the top of a respective one of said subsets and portions of said first pseudowire extending across said at least one pair of adjacent vertical strings at the top of a respective one of said subsets are twisted together with respective portions of said return and bypass wires.

26. A single wire net light set defining a plurality of single wire net light subsets, each set comprising:

(A) at one end of said set, a plug having a pair of conductors for connection to a power supply or an end connector of another light set;

(B) a bypass wire extending across said set in electrical communication with a live one of said conductors;

(C) a return wire extending across said set in electrical communication with a return one of said conductors;

said bypass wire extending essentially directly across said set at a top thereof, and said return wire extending in a U-shape configuration along one vertically extending side, a bottom, and another vertically extending side of said set;

(D) a plurality of active wires, each active wire extending across a respective one of said subsets substantially in a plurality of electrically and physically interconnected, horizontally spaced vertical strings and being in electrical and physical communication with said bypass wire at a beginning end of a respective subset and said return wire at a terminal end of a respective subset;

(E) a plurality of lamp sockets disposed in series in electrical and physical communication and spaced along said active wire of each subset;

(F) at an opposite end of said set, an end element selected from the group consisting of an end connector adapted to receive the plug of another light set and means electrically connecting adjacent free ends of said bypass and return wires, (G) a first non-electrical pseudowire resembling said active wire in outward appearance and being twisted together with said active wire in each subset intermediate said lamp sockets thereof in order to provide additional tensile strength to each said vertical string of said subset;

said first pseudowire being twisted together with said active wire in each vertical string in each subset except a first vertical string of the first subset and a last vertical string of the last subset, said active wire of said first and last vertical strings being twisted together with portions of said return wire extending along said vertically extending sides of said set, and, alternately, portions of said active wire extending across at least one pair of adjacent vertical strings at the bottom of a respective one of said subsets and portions of said first pseudowire extending across at least one other pair of adjacent vertical strings at the bottom of a respective one of said subsets are twisted together with respective successive portions of said return wire; and (H) at least one second non-electrical pseudowire resembling said active wire in outward appearance and connecting horizontally aligned segments of said vertical strings of said set to form a net appearance.

27. A net light set comprising:

(A) a common wire means extending in a first direction, said common wire means including lengths of a single bypass wire and a single return wire;

(B) a plurality of series-connected light strings extending physically parallel to each other and exclusively in a second direction transverse to the first direction, each said light string including a plurality of lamp sockets and a plurality of intermediate lengths of said single active wire connecting said lamp sockets in series, in each of said light strings intermediate the first and last light strings said single active wire being spaced from any other light string and twisted together intermediate said lamp sockets only with a first non-wire extending exclusively in the second direction for enhanced tensile strength and forming about each lamp socket a socket-entering single active wire portion and a socket-leaving single active wire portion;

(C) at least one second non-wire extending in the first direction and physically connecting intermediate lengths of each said light string with corresponding intermediate lengths of other light strings; and (D) plug means disposed at one end of said light set and including said active and return wires;

adjacent each of said lamp sockets in each of said light strings intermediate the first and last light strings and intermediate the top and bottom lamp sockets, said second non-wire extending in said first direction and criping one of said socket-entering and socket-leaving single active wire portions about the other single active wire portion;

whereby said second non-wire blocks sliding movement of said lamp socket in both the first and second directions, thereby to provide said set with a net appearance.

28. The set of claims 27 wherein said second non-wire extends in said first direction to one side of said socket-entering single active wire portion then to an opposite side of said socket-leaving single active wire portion and said socket-entering single active wire portion, and finally looping about said socket-entering single active wire portion before continuing intermediate said socket-entering and said socket-leaving single active wire portions in said first direction.

29. The set of claim 27 wherein spaced apart lengths of said first non-wire on opposite sides of a respective one of said lamp sockets are bridged by a third length of said first non-wire bypassing said respective one lamp socket.

30. The set of claim 27 additionally including means for commonly orienting said lamp sockets relative to one of said socket-entering and socket-leaving single active wires, said orienting means not blocking sliding movement of said lamp socket.

31. The set of claim 28 wherein the one side is in the rear and the opposite side is in the front.

32. The set of claim 28 wherein the first direction is substantially horizontal, and the second direction is substantially vertical.

33. The set of claim 27 wherein said first non-wire has a tensile strength of at least 28 pounds.

34. The set of claim 33 wherein said second non-wire has a tensile strength of less than 28 pounds.

35. The net light of claim 1 wherein said at least one second non-wire physically connects intermediate lengths of each said light string at points closely adjacent said lamp sockets thereof with intermediate lengths of other light strings at points closely adjacent said lamp sockets thereof.

36. The net light of claim 1 wherein said at least one second non-wire physically connects intermediate lengths of each said light string at points remotely adjacent said lamp sockets thereof with intermediate lengths of other light strings at points remotely adjacent said lamp sockets thereof.

37. The net light set of claim 9 wherein said at least one second non-electrical pseudowire connects horizontally aligned segments of said vertical strings at points closely adjacent said lamp sockets.

38. The net light set of claim 9 wherein said at least one second non-electrical pseudowire connects horizontally aligned segments of said vertical strings at points remotely adjacent said lamp sockets.

39. The net light set of claim 25 wherein said at least one second non-electrical pseudowire connects horizontally aligned segments of said vertical strings at points closely adjacent said lamp sockets.

40. The net light set of claim 25 wherein said at least one second non-electrical pseudowire connects horizontally aligned segments of said vertical strings at points remotely adjacent said lamp sockets.

41. The net light set of claim 26 wherein said at least one second non-electrical pseudowire connects horizontally aligned segments of said vertical strings at points closely adjacent said lamp sockets.

42. The net light set of claim 26 wherein said at least one second non-electrical pseudowire connects horizontally aligned segments of said vertical strings at points remotely adjacent said lamp sockets.

* * * * *